US008733868B1

(12) United States Patent
Polk et al.

(10) Patent No.: US 8,733,868 B1
(45) Date of Patent: May 27, 2014

(54) DIRECT-TO-PRODUCT PRINTING TRAY INCLUDING A TRACKING LABEL-DISPENSING MECHANISM

(71) Applicants: Michael Lane Polk, Mint Hill, NC (US); Gregory Lee Franklin, Indian Trail, NC (US)

(72) Inventors: Michael Lane Polk, Mint Hill, NC (US); Gregory Lee Franklin, Indian Trail, NC (US)

(73) Assignee: Fujifilm North America Corporation, Valhalla, NY (US)

( * ) Notice: Subject to any disclaimer, the term of this patent is extended or adjusted under 35 U.S.C. 154(b) by 71 days.

(21) Appl. No.: 13/680,909

(22) Filed: Nov. 19, 2012

(51) Int. Cl.
*B41J 3/00* (2006.01)
*B41J 2/01* (2006.01)

(52) U.S. Cl.
USPC ..... 347/4; 347/101; 347/104

(58) Field of Classification Search
USPC ..... 347/4, 101, 104
See application file for complete search history.

(56) References Cited

U.S. PATENT DOCUMENTS

| | | | | |
|---|---|---|---|---|
| 7,147,219 | B2 | 12/2006 | Soo | |
| 7,547,081 | B2 * | 6/2009 | Martinez | 347/2 |
| 2009/0256897 | A1 | 10/2009 | Polk et al. | |
| 2010/0013880 | A1 | 1/2010 | Polk et al. | |
| 2010/0186610 | A1 * | 7/2010 | Polk et al. | 101/35 |

* cited by examiner

*Primary Examiner* — Sarah Al Hashimi
(74) *Attorney, Agent, or Firm* — Blakely, Sokoloff, Taylor & Zafman LLP

(57) ABSTRACT

A direct-to-product printing tray to hold a photo product and a plurality of labels in place while a composite image is printed on the photo product and a first label. The direct-to-product printing tray includes a label-dispensing system within the direct-to-product tray. The label-dispensing system is configured to automatically advance a second label to a position previously occupied by the first label in response to the removal of the first label from the label-dispensing system.

20 Claims, 8 Drawing Sheets

DIRECT-TO-PRODUCT PRINTING TRAY INCLUDING A TRACKING LABEL-DISPENSING MECHANISM

FIELD

Embodiments of the present invention relate generally to the field of image transfer. In particular, embodiments of the present invention relate to direct-to-product printing and a direct-to-product printing tray that includes a dispensing mechanism for tracking labels, which are printed as a part of a composite image of personalized images for photo products.

BACKGROUND

Direct-to-product printing is a process of transferring a digital image to a product using an inkjet printer to adhere ink directly to a product. The product may include wood, glass, ceramic, metal, plastic, or another material that is compatible with the ink. For example, a personalized photo product such as an ornament may be created by printing a personalized image on the ornament.

Direct-to-product printing may be used by a business to generate personalized photo products for customers. With products that include unique and personal images, there is a need to make certain that each product is shipped or otherwise delivered to the correct customer. As greater numbers of personalized photo products are printed (e.g., in mass production of products including unique images), the occurrences of shipping a personalized photo product to the wrong customer increases due to incorrectly matching the shipping labels to the product.

SUMMARY

A direct-to-product printing tray is described. The direct-to-product printing tray holds a photo product and a plurality of labels in place while a composite image is printed on the photo product and a first label. The direct-to-product printing tray includes a label-dispensing system within the direct-to-product tray. The label-dispensing system is configured to automatically advance a second label to a position previously occupied by the first label in response to the removal of the first label from the label-dispensing system.

In one embodiment, the composite image includes a plurality of personalized images and a plurality of label images. Each label indicia image includes order tracking information associated with one of the plurality of personalized images. The position of each personalized image within the composite image corresponds to a position of a separate photo product on the direct-to-product printing tray and the position of each label indicia image within the composite image corresponds to a position of a separate label on the direct-to-product printing tray.

Other features and advantages of embodiments of the present invention will be apparent from the accompanying drawings and from the detailed description that follows.

BRIEF DESCRIPTION OF THE DRAWINGS

Embodiments of the present invention are illustrated by way of example and not limitation in the figures of the accompanying drawings, in which like references indicate similar elements, and in which.

DETAILED DESCRIPTION

A method and apparatus for printing tracking labels as a part of a composite image of personalized images for photo products are described. In the process of transferring unique or personalized digital images to specialty products (referred to herein as photo products), a manufacturer may produce great numbers of unique or personalized photo products. For example, a composite image may be used to print a dozen or more personalized photo products in a single print cycle. Each customer order, however, may include as few as only one personalized photo product and each photo product may be unique amongst the remainder of personalized photo products. Unlike the mass manufacturing of nearly identical products, tracking each individual photo product and shipping it to the correct customer is of great importance. Printing tracking information directly onto the photo product, however, would detract from the appearance of the photo product. Printing to both the photo products and separate corresponding tracking labels within the same print cycle, with the labels in close physical proximity to corresponding photo products, reduces the likelihood of mislabeling each photo product without altering the appearance of the photo product. A neighboring label can be removed from the direct-to-product printing tray and placed on the photo product (e.g., temporarily) or on packaging or a container for the photo product, providing customer, shipping, or consolidation storage (e.g., a temporary manufacturing holding place for multiple product orders) information for that photo product and thereby reducing the likelihood of shipping a personalized photo product to the wrong customer.

Additionally, a direct-to-product printing tray is described. The direct-to-product printing tray holds a photo product and a plurality of labels in place while a composite image is printed on the photo product and a first label. The direct-to-product printing tray includes a label-dispensing system within the direct-to-product tray. The label-dispensing system is configured to automatically advance a second label to a position previously occupied by the first/top label in response to the removal of the first label from the label-dispensing system. The label-dispensing system enables a direct-to-product printing tray to be loaded with a bulk quantity of labels for each label printing position on the tray. Labels are, therefore, reloaded less frequently than loading single labels for each location. Reloading a direct-to-product printing tray with pre-loaded removable cartridges of labels further expedites the printing process.

Figure 1:
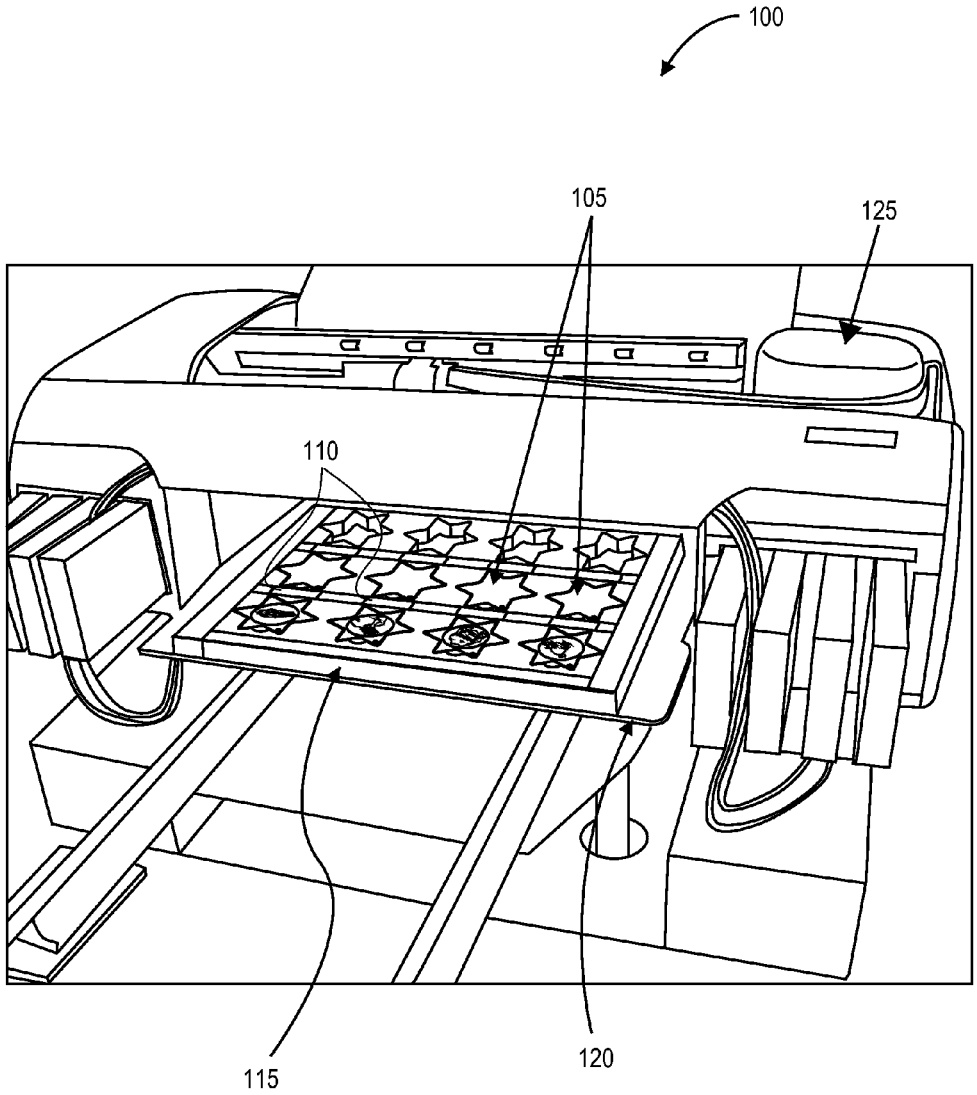
FIG. 1 illustrates a perspective view of an exemplary direct-to-product printer for printing to photo products and labels on a direct-to-product printing tray.

FIG. 1 illustrates a perspective view of an exemplary direct-to-product printer 100 for printing to photo products 105 and labels 110 on a direct-to-product printing tray 115. In one embodiment, the printer 100 is a flatbed inkjet printer that uses multiple (e.g., eight) individual inks. In one embodiment, the printer 100 includes a flatbed platter or "platen" 120 to secure the direct-to-product printing tray 115. The direct-to-product printing tray 115 is designed to hold photo products 105 in place during the printing process. Additionally, the direct-to-product printing tray 115 holds top surfaces of the photo products 105 and labels 110 at or near the same height (relative to the printer 100) to allow the printer head 125 to move above and project ink onto the corresponding surfaces of the photo products 105 and labels 110. A top portion of each photo product and each label (relative to the direct-to-product printing tray 115) receives a printed image. As will be described below, the direct-to-product printing tray 115 holds the photo products 105 and labels 110 in positions aligned with portions of a composite image.

The flatbed platter 120 may move along one or more axes or remain stationary while the printer assembly translates along one or more axes, to position the photo products 105 and labels 110 to be printed. In one embodiment, the printer head 125 of the printer 100 and flatbed platter 120 collectively move along three (x, y, and z) axes. For example, the flatbed platter 120 may move along an x axis, the printer head 125 may move along a y axis, and the flatbed platter 120 may also be adjustable or move along a z axis. An embodiment that allows movement along a z axis enables adjustments for trays, labels, and/or photo products of different heights by raising or lowering the platter 120 relative to the height of the printer/printer head 125.

In one embodiment, the printer 100 is coupled to a data processing system, such as the data processing system described below with reference to FIG. 5. The data processing system transmits image and print command data to the printer 100 over a wired or wireless connection to cause the printer 100 to print personalized images to the photo products 105 and tracking labels to the labels 110. In an alternate embodiment, such a data processing system is incorporated within the printer 100 and receives image and tracking data.

Figure 2:
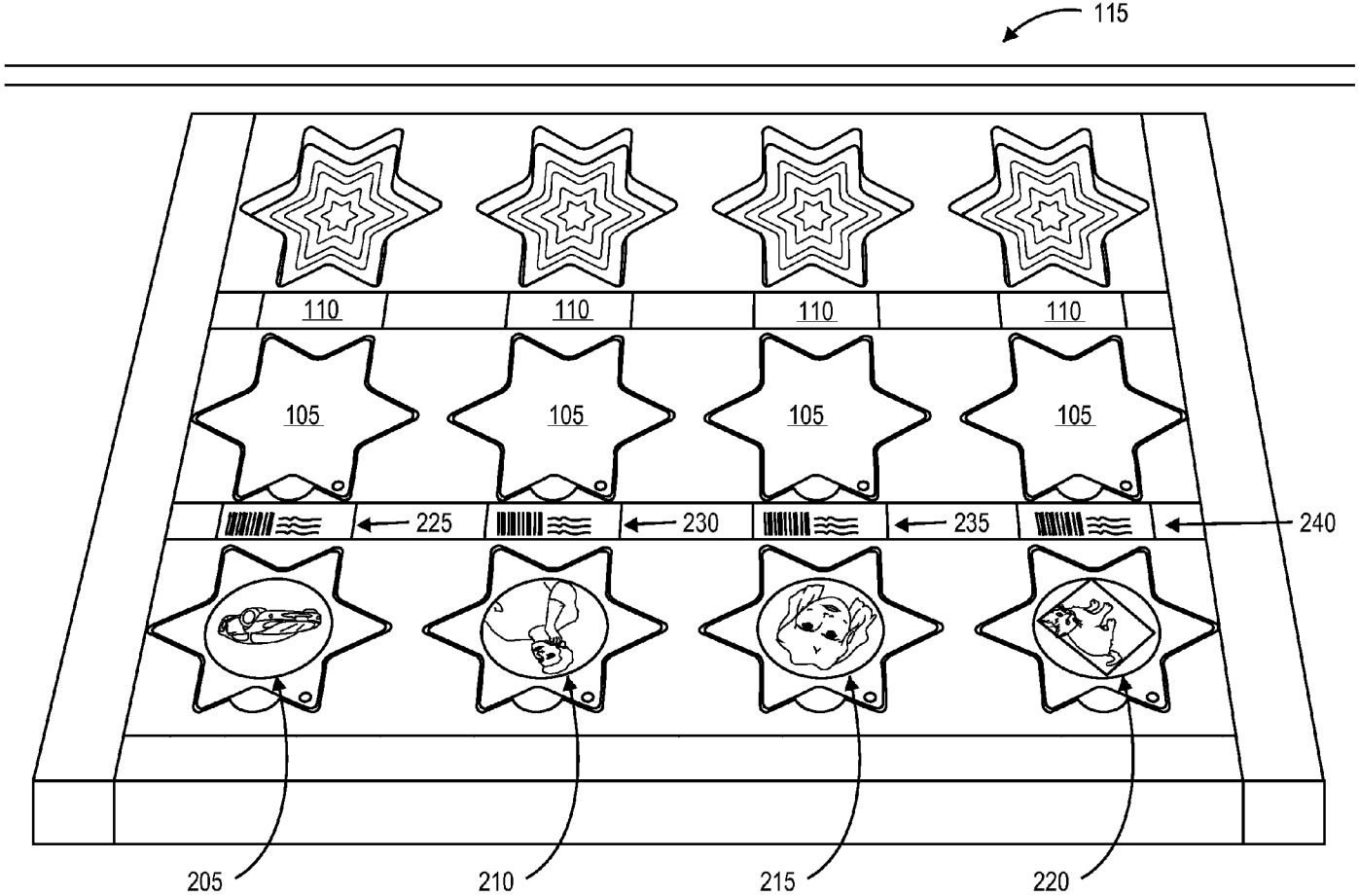
FIG. 2 shows a perspective view of the direct-to-product printing tray illustrated in FIG. 1.

FIG. 2 shows a perspective view of the direct-to-product printing tray 115 illustrated in FIG. 1. In one embodiment, the photo products 105 and the labels 110 are separate items. The tracking information for each photo product is printed onto a label 110 and not directly onto the photo product 105. In the illustrated exemplary embodiment, the direct-to-product printing tray 115 holds rows of star-shaped photo products 105 and, in between the rows of photo products 105, rows of labels 110. In one embodiment, the use of alternating rows of photo products 105 and labels 110 enables a printed photo product 105 to be in close physical proximity to a corresponding printed label 110. The possibility of mislabeling or losing track of the photo product 105 is reduced by printing tracking information on a neighboring label 110. A person or automated system may easily match corresponding photo products 105 and labels 110 as a print cycle completes.

To illustrate the embodiments described herein, only one row of photo products 105 has been printed with personalized images 205, 210, 215, and 220, and only one row of labels 110 has been printed with tracking information 225, 230, 235, and 240. Additionally, at least one row of photo products 105 and one row of labels 110 have been illustrated without being printed. According to the embodiments set forth herein, multiple rows of photo products 105 and multiple rows of labels 110 may be printed in a single print cycle. As used herein, a single print cycle refers to the printer 100 transferring a single composite image onto photo products 105 and labels 110.

Each of the personalized images 205, 210, 215, and 220 corresponds respectively to the tracking information 225, 230, 235, and 240. Once printed, a label 110 can be used to track or indicate shipping information for a corresponding photo product 105. For example, the photo product 105 printed with a personalized image 205 corresponds to the neighboring label 110 printed with tracking information 225. The label 110 with tracking information 225 may be removed from the direct-to-product printing tray 115 and affixed (e.g., via an adhesive) to the photo product 105 printed with the personalized image 205 or to a container (not shown) that will store and/or be used to ship the photo product 105 printed with the personalized image 205.

Figure 3:
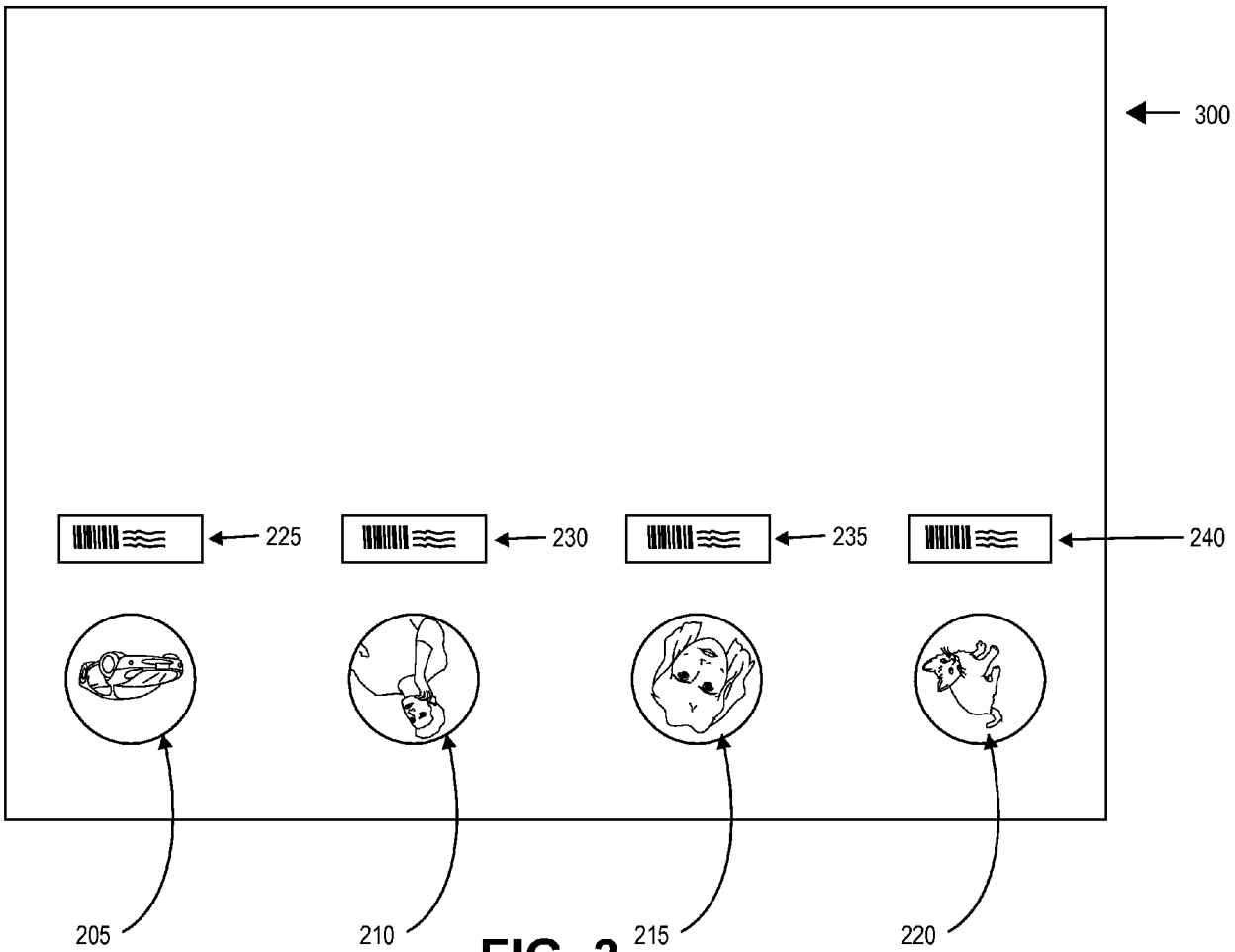
FIG. 3 illustrates an exemplary composite image according to an embodiment of the invention.

FIG. 3 illustrates an exemplary composite image 300 according to an embodiment of the invention. In one embodiment, each personalized image 205, 210, 215, and 220 is associated with a customer order. For example, a customer may select a photo product and transmit a digital photograph or other image (e.g., via a commercial website, by email, cell phone, portable device, kiosk, etc.) to personalize that photo product.

The order for the personalized photo product will include customer information, such as the customer's name, address, or other shipping and/or order data. The customer information is combined with manufacturing information and used to generate tracking information 225, 230, 235, and 240. In one embodiment, the tracking information 225, 230, 235, and 240 includes a bar code. Alternatively, the tracking information 225, 230, 235, and 240 includes a customer name, a customer address, a number, a quick response (QR) code, other identification, manufacturing, or tracking information, or a combination thereof. In one embodiment, the bar code or other tracking information 225, 230, 235, and 240 is associated with customer shipping data, such as a name and address. As used herein, tracking information is used interchangeably with label images and label indicia images.

In one embodiment, the tracking information 225, 230, 235, and 240 includes a bin number or location, e.g., to identify a bin to accumulate multiple products ordered by a single customer. Use of a bin allows multiple products to be consolidated for a single customer's order. The tracking information (e.g., within the barcode) can be scanned for each item to determine the bin and/or customer order to which multiple products belong. This reduces the likelihood of shipping products to the wrong customer.

The personalized images 205, 210, 215, and 220 and corresponding label indicia images 225, 230, 235, and 240 are processed to generate a composite image 300. In one embodiment, the position of each personalized image 205, 210, 215, and 220 within the composite image 300 corresponding to a position of a separate photo product 105 on the direct-to-product printing tray 115; and the position of each label image 225, 230, 235, and 240 within the composite image 300 corresponding to a position of a separate label 110 on the direct-to-product printing tray 115. The correspondence between positions within the composite image 300 and items on the direct-to-product printing tray 115 may be calibrated by determining a size ratio or other physical correspondence or registration between the bounds of the composite image 300 and the direct-to-product printing tray 115. The circular and rectangular borders illustrated for the personalized images 205, 210, 215, and 220 and the label images 225, 230, 235, and 240, respectively, are included as an indication of the registration of position of images and the physical items on the direct-to-product printing tray 115. In one embodiment, however, the borders are not included in the composite image 300.

A composite template may be used to generate the composite image. In one embodiment, the composite template is based upon the position correspondence described above and the number of photo products 105 and labels 110 held by a single direct-to-product printing tray 115. A processing device may generate or receive the label images 225, 230, 235, and 240 corresponding to the personalized images 205, 210, 215, and 220 to be printed. The processing device may automatically arrange these images into the template by placing a predetermined number of the personalized images 205, 210, 215, and 220 and label images 225, 230, 235, and 240 into predetermined locations within the template without user input. Once the composite template includes all of the images (e.g., up to a limit of the number of images that it may hold), the composite template may be saved or transmitted as a single image for printing.

Figure 4:
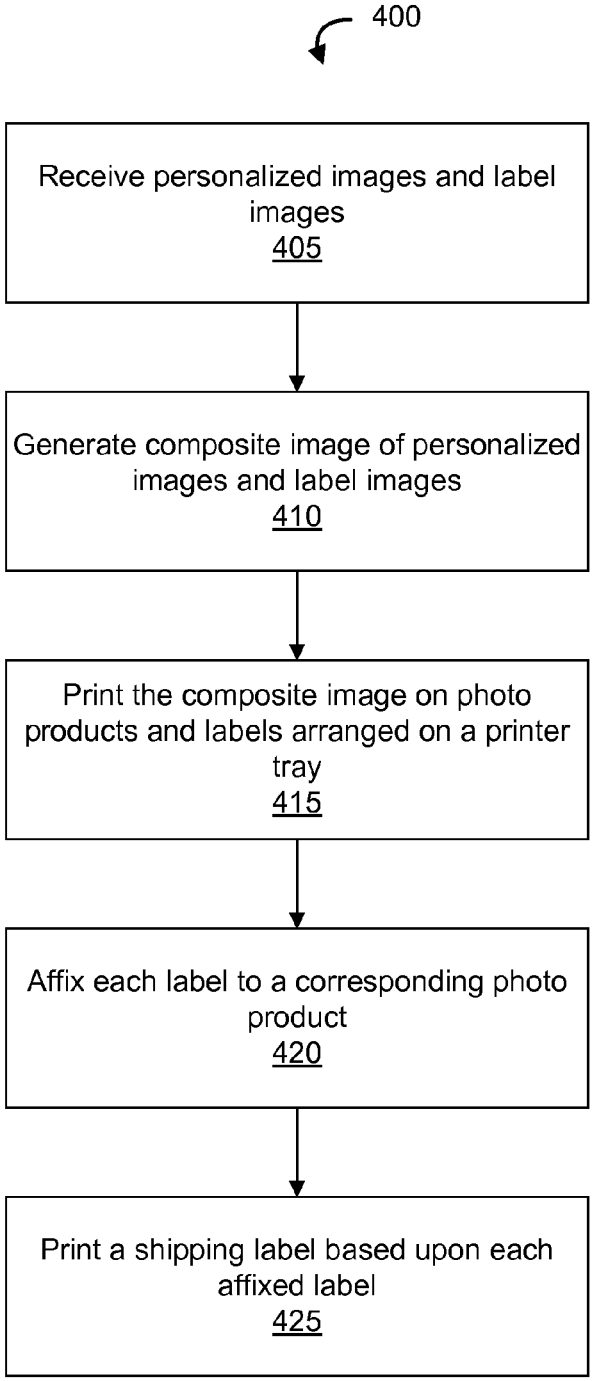
FIG. 4 is a flow chart illustrating a method of printing tracking labels as a part of a composite image of personalized images for photo products according to an embodiment of the invention.

FIG. 4 is a flow chart illustrating a method 400 of printing tracking labels 110 as a part of a composite image 300 of personalized images for photo products 105 according to an embodiment of the invention. At block 405, a processing device receives one or more digital photographs or other personalized images 205, 210, 215, and 220 and customer data. The customer data may be in the form of the label indicia images 225, 230, 235, and 240 described above, or the processing system may generate the label indicia images 225, 230, 235, and 240 from the customer data.

At block 410, the processing device generates a composite image 300 of one or more personalized images 205, 210, 215, and 220 and label idicia images 225, 230, 235, and 240 as described above with reference to FIG. 3. At block 415, the composite image 300 including the personalized images 205, 210, 215, and 220 and label images 225, 230, 235, and 240 is printed onto photo products 105 and labels 110 arranged on a direct-to-product printing tray 115.

At block 420, each printed label 110 is removed and affixed to a neighboring or corresponding photo product 105. For example, a printed label 110 may include a removable surface that exposes an adhesive for temporarily affixing the label 110 to a portion of the corresponding printed photo product 105. Alternatively, the printed label 110 may be affixed to a container (e.g., for storage or shipping) that receives the corresponding printed photo product 105.

At block 425, each printed label 110 is optionally scanned or otherwise read to print a shipping label or identify a temporary storage location. If printing a shipping label, the shipping label is affixed to a shipping container that receives the photo product 105. If identifying a storage location, the storage location is determined and the product is placed into the storage location. In one embodiment, the printed and affixed label 110 described with reference to blocks 415 and 420 is shipping label. In an embodiment in which multiple photo products 105 are consolidated into a single order, fewer shipping labels may be needed than the number of photo products 105 (e.g., when multiple products shipped in a single shipping container) and, therefore, a shipping label is not printed for each printed label 110.

Figure 5:
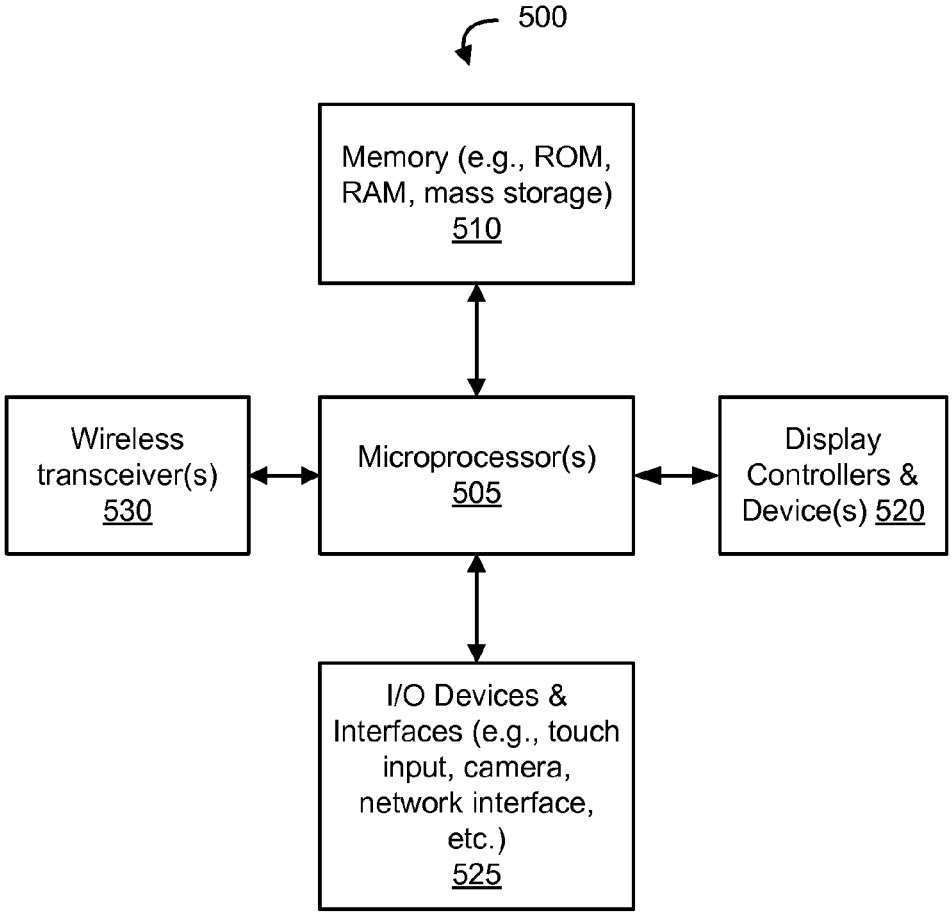
FIG. 5 illustrates, in block diagram form, an exemplary processing system that can print tracking labels as a part of a composite image of personalized images for photo products.

FIG. 5 illustrates, in block diagram form, an exemplary data processing system 500 that can print tracking labels as a part of a composite image of personalized images for photo products, as described herein. Data processing system 500 may include one or more microprocessors 505 and connected system components (e.g., multiple connected chips) or the data processing system 500 may be a system on a chip.

The data processing system 500 includes memory 510 which is coupled to the microprocessor(s) 505. The memory 510 may be used for storing data, metadata, and programs for execution by the microprocessor(s) 505. The memory 510 may include one or more of volatile and non-volatile memories, such as Random Access Memory ("RAM"), Read Only Memory ("ROM"), a solid state disk ("SSD"), Flash, Phase Change Memory ("PCM"), or other types of data storage.

A display controller and display device 520 provides a visual user interface for the user; this user interface may include a graphical user interface which, for example, is similar to that shown on a computer when running operating system software.

The system 500 also includes one or more input or output ("I/O") devices and interfaces 525 which are provided to allow a user to provide input to, receive output from, and otherwise transfer data to and from the data processing system 500 (e.g., personalized images, tracking information, manufacturing information, label images, composite images, printer commands, etc.). These I/O devices may include a mouse, keypad or a keyboard, a touch panel or a multi-touch input panel, scanner, barcode reader, camera, network interface, modem, other known I/O devices or a combination of such I/O devices. The I/O devices and interfaces 525 may also include a connector for a dock or a connector for a USB interface, FireWire, Thunderbolt, Ethernet, etc. to connect the system 500 with a network or another device or external component, such as the printer 100 described above.

Data processing system 500 also includes one or more wireless transceivers 530, such as an IEEE 802.11 transceiver, an infrared transceiver, a Bluetooth transceiver, a wireless cellular telephony transceiver (e.g., 1G, 2G, 3G, 4G), or another wireless protocol to connect the data processing system 500 with a network or another device or external component, such as the printer 100 described above. Similar to the I/O devices and interfaces 525 above, the wireless transceiver (s) 530 enable the transfer of data to and from the data processing system (e.g., personalized images, tracking information, label images, composite images, printer commands, etc.).

The data processing system 500 may be a personal computer, tablet-style device, a personal digital assistant (PDA), a handheld computer (which may include a cellular telephone), or devices which combine aspects or functions of these devices. In other embodiments, the data processing system 500 may be a network computer or an embedded processing device within another device or consumer electronic product, such as printer 100. As used herein, the terms "computer," "processing device," and "apparatus comprising a processing device" may be used interchangeably with the data processing system 500 and include the above-listed exemplary embodiments.

It will be appreciated that one or more buses, may be used to interconnect the various components shown in FIG. 5. It will be appreciated that additional components, not shown, may also be part of the system 500, and, in certain embodiments, fewer components than that shown in FIG. 5 may also be used in a data processing system 500.

It will be apparent from this description that aspects of the invention may be embodied, at least in part, in software. That is, the computer-implemented method 400 may be carried out in a computer system or other data processing system 500 in response to its processor or processing system executing sequences of instructions contained in a memory, such as memory 510 or other machine-readable storage medium. The software may further be transmitted or received over a network (not shown) via a network interface device 525/530. In various embodiments, hardwired circuitry may be used in combination with the software instructions to implement the present embodiments. Thus, the techniques are not limited to any specific combination of hardware circuitry and software, or to any particular source for the instructions executed by the data processing system 500.

Figure 6:
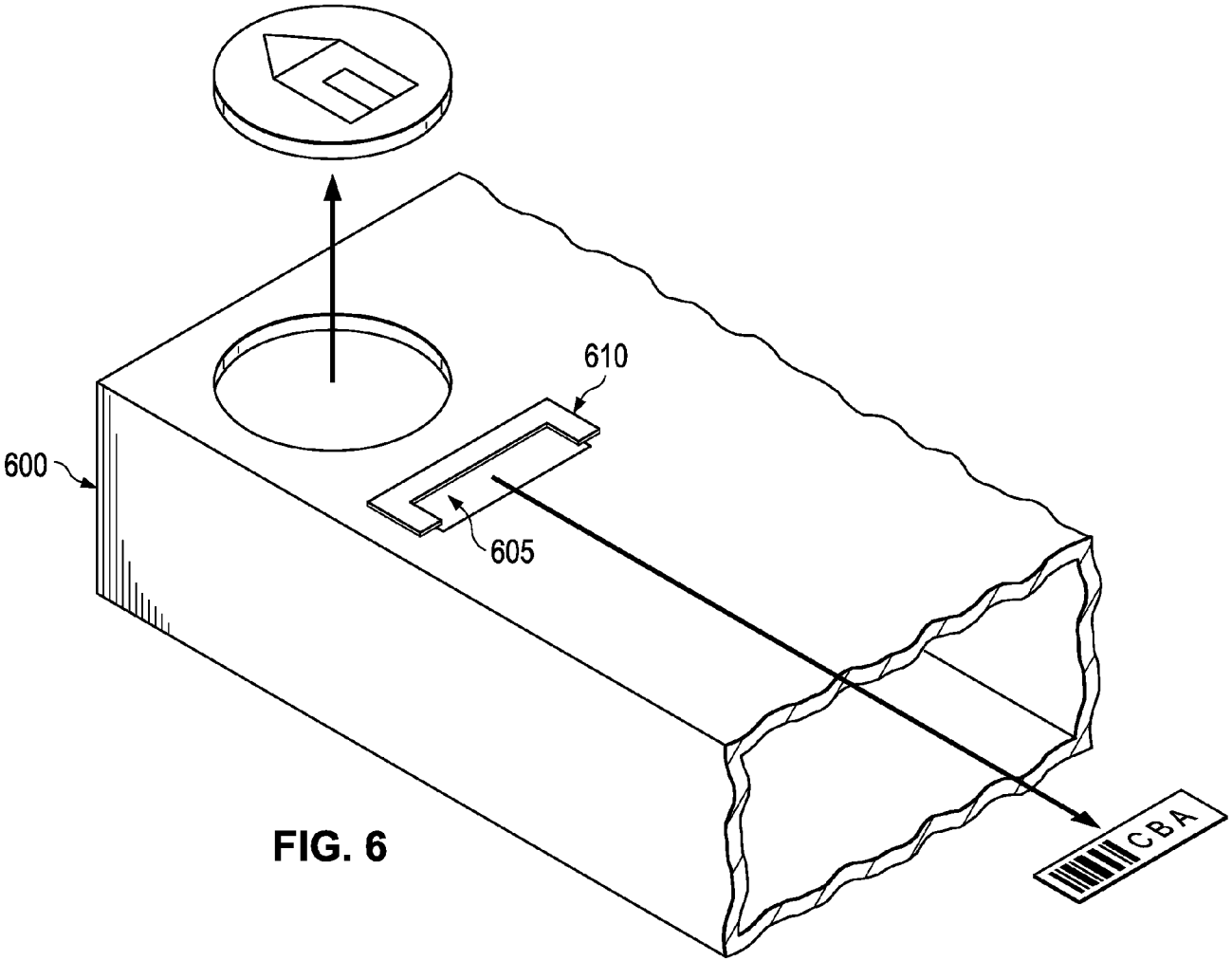
FIG. 6 illustrates a partial view of an exemplary direct-to-product printing tray including a label-dispensing system.

FIG. 6 illustrates a partial view of an exemplary direct-to-product printing tray 600 including a label-dispensing system 605. The label-dispensing system 605 is configured to hold a stack of labels and exert an upward force upon the stack of labels using, e.g., a spring-loaded follower (described further below) or similar mechanism to exert an upward force or otherwise advance a next label (from a stack, roll, etc.), such as a motor, solenoid, electro-mechanic device, magnet, pneumatic device, etc. The direct-to-product printing tray 600 includes a retaining lip or plate 610.

The label-dispensing system 605 is configured to, in response to the removal of the top label, automatically advance a second label to a position previously occupied by the top label. In one embodiment, the retaining lip 610 exerts a downward force upon the stack of labels (i.e., counteracts the upward force of the spring-loaded follower). The retaining lip 610 retains the stack of labels within the label-dispensing system. When a label on top of the stack is removed by sliding the top label laterally through an open portion of the retaining lip 610, the spring-loaded follower moves the remaining stack of labels upward until the next label reaches the retaining lip 610.

In one embodiment the retaining lip 610 retains a removable cartridge of labels within the direct-to-product printing tray 600, as will be described in more detail below.

Figure 7:
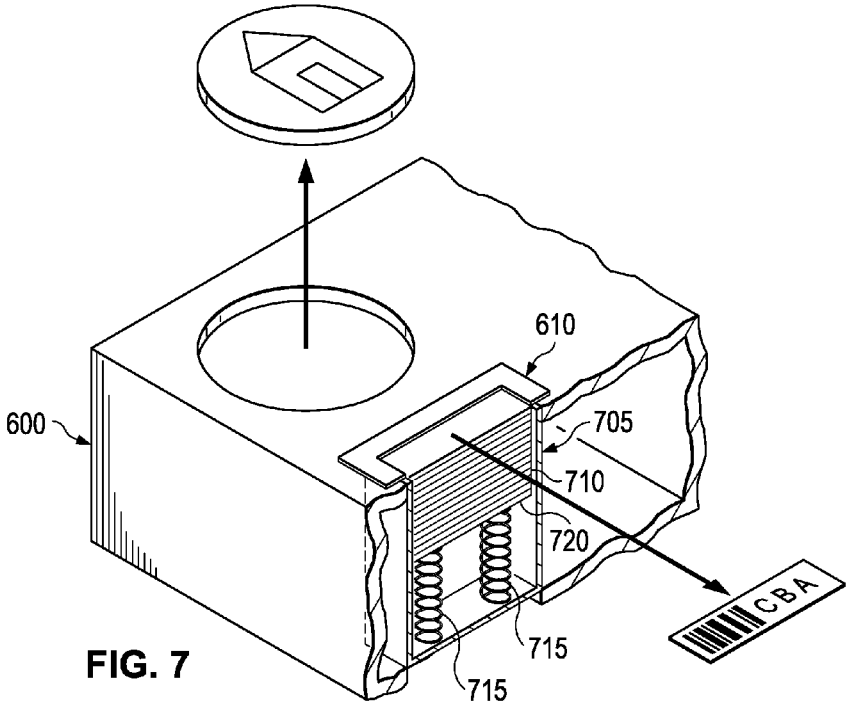
FIG. 7 illustrates a sectional view of the label-dispensing system within the direct-to-product printing tray illustrated in FIG. 6.

FIG. 7 illustrates a sectional view of a label-dispensing system 705 of the direct-to-product printing tray 600 illustrated in FIG. 6. As described above, the label-dispensing system 705 holds a stack of labels 710. One or more springs 715 exert an upward force upon a follower 720, which in turn pushes the stack of labels 710 toward an opening in a top portion of the label-dispensing system 705.

In one embodiment, a top portion of the label-dispensing system 705 opens to receive labels. For example, the retaining lip 610 may utilize a locking hinge and rotate to allow a stack of labels 710 to be inserted within the label-dispensing system 705. Alternatively, the retaining lip 610 may slide laterally (with reference to the top surface of the direct-to-product printing tray 600) to allow for a stack of labels to be inserted within the label-dispensing system 705. Alternatively, a bottom portion of the label-dispensing system 705 opens to receive labels. For example, opening or removing a bottom portion of the label-dispensing system 705 would enable the removal of the spring(s) 715 and follower 720 and a stack of labels 710 to be inserted within the label-dispensing system 705. Once the stack 710 is inserted, the bottom portion, spring (s) 715, and follower 720 are returned to positions to enable the follower to exert an upward force upon the stack of labels 710.

In one embodiment, the label-dispensing system is permanently affixed within the direct-to-product printing tray 600. Alternatively, the label-dispensing system includes a cartridge to be inserted into and removed from the direct-to-product printing tray 600.

Figure 8:
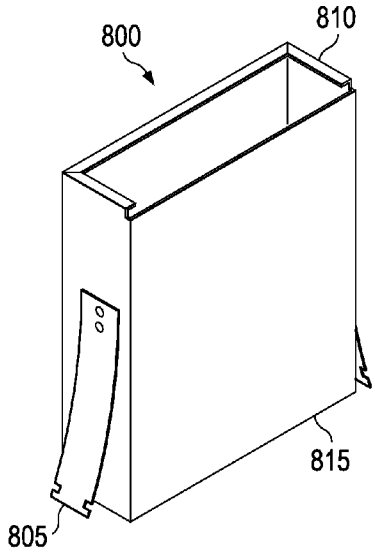
FIG. 8 illustrates an exemplary removable label-dispensing cartridge.

FIG. 8 illustrates an exemplary removable label-dispensing cartridge 800. The removable label-dispensing cartridge 800 expedites the reloading of a direct-to-product printing tray with a bulk quantity of tracking labels. One or more preloaded cartridges 800 may be exchanged for empty cartridges 800, which will place the direct-to-product printing tray back into use faster than refilling the label-dispensing system(s) 705 embedded/permanent affixed within the tray and faster than reloading and replacing one or more removable label-dispensing cartridge(s) 800 with bulk quantities of tracking labels.

The removable label-dispensing cartridge 800 includes one or more springs or latches 805 to secure the label-dispensing cartridge 800 in place when inserted within a direct-to-product printing tray. The label-dispensing cartridge 800 further includes a retaining lip 810 to retain a stack of labels within label-dispensing cartridge 800 when an upward force is exerted upon the stack, e.g., by the spring-loaded follower described above. In one embodiment, the retaining lip 610 of the direct-to-product tray is omitted when the retaining lip 810 of the label-dispensing cartridge 800 retains the labels and a latch or other mechanism secures the label-dispensing cartridge 800 in place within the direct-to-product printing tray.

In one embodiment, a top portion of the label-dispensing cartridge 800 opens to receive labels. For example, the retaining lip 810 may utilize a locking hinge and rotate to allow a stack of labels to be inserted within the label-dispensing cartridge 800. Alternatively, a bottom portion 815 of the label-dispensing cartridge 800 opens to receive labels. For example, opening or removing a bottom portion 815 would enable the removal of the spring(s) and follower and a stack of labels could be inserted within the label-dispensing cartridge 800. Once the stack of labels is inserted, the bottom portion 815, spring(s), and follower are returned to positions to enable the follower to exert an upward force upon the stack of labels.

In one embodiment, a top portion of the direct-to-product printing tray opens to receive the label-dispensing cartridge 800. For example, the retaining lip 610 may utilize a locking hinge and rotate to allow the label-dispensing cartridge 800 to be inserted within the direct-to-product printing tray. Alternatively, a bottom portion of the direct-to-product printing tray opens to receive the label-dispensing cartridge 800. Once inserted, one or more springs, latches, or other fasteners 805 secure the label-dispensing cartridge 800 in place.

Figure 9:
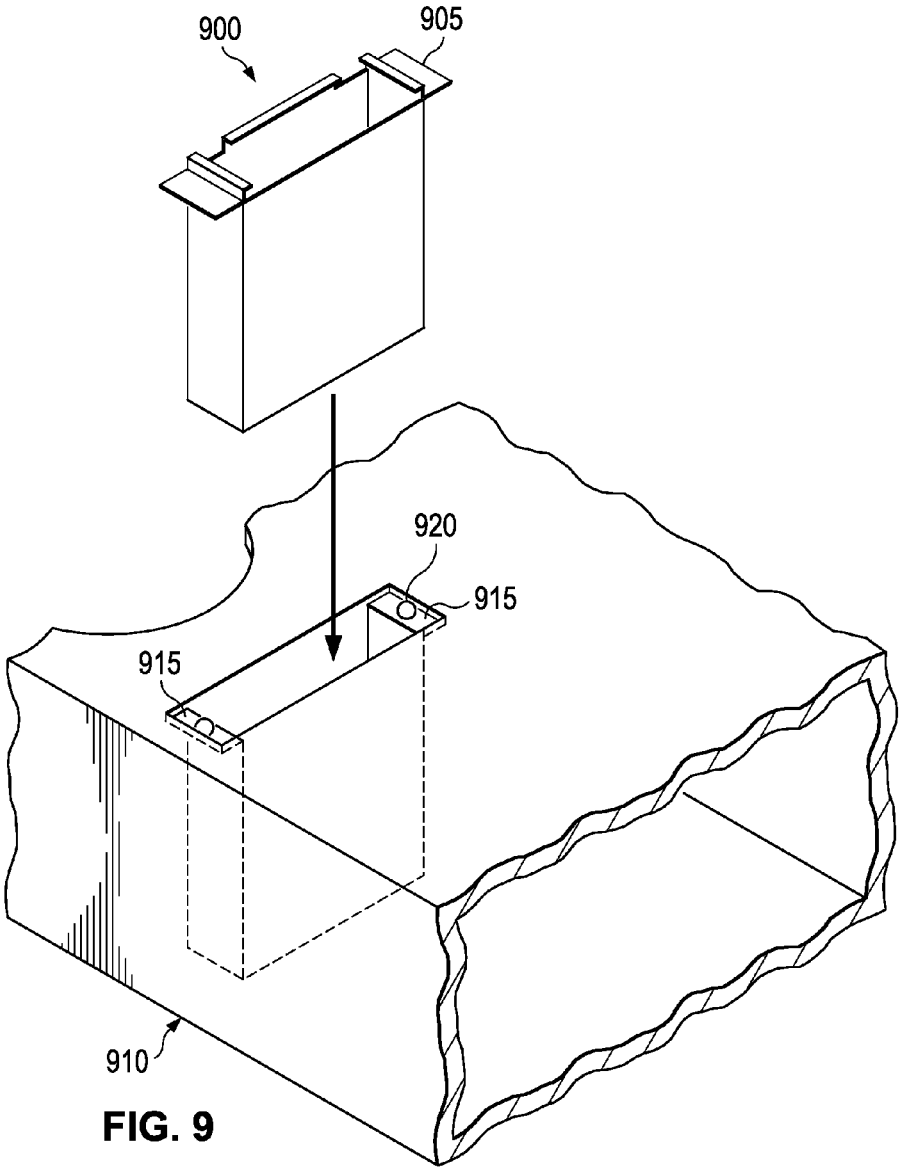
FIG. 9 illustrates another removable label-dispensing cartridge and corresponding partial view of an exemplary direct-to-product printing tray.

FIG. 9 illustrates another removable label-dispensing cartridge 900 and corresponding partial view of an exemplary direct-to-product printing tray 910. The removable label-dispensing cartridge 900 includes flanges 905 to facilitate the positioning of the removable label-dispensing cartridge 900 when inserted within the direct-to-product printing tray 910. For example, the direct-to-product printing tray 910 includes recesses 915 configured to receive the flanges 905 of the removable label-dispensing cartridge 900. In one embodiment, the direct-to-product printing tray 910 includes magnets 920 within the recesses to further secure the removable label-dispensing cartridge 900 (e.g., the flanges 905 are susceptible to the attractive force of the magnets 920). Alternatively or additionally, the flanges 905 include magnets to secure the removable label-dispensing cartridge 900 in place within the direct-to-product printing tray 910. In yet another embodiment, the flanges 905 are used in conjunction with a spring, latch, or other fastener.

In the foregoing specification, the invention has been described with reference to specific exemplary embodiments thereof. It will be evident that various modifications may be made thereto without departing from the broader spirit and scope of the invention. For example, embodiments described herein refer to photo products that receive personalized or unique customer images. Other products that receive printed images, however, may also be printed as described herein.

Additionally, while the figures illustrate a photo product in the shape of a star, other photo products, and a corresponding direct-to-product printing tray, may be used in accordance with embodiments of the invention described herein. The specification and drawings are, accordingly, to be regarded in an illustrative sense rather than a restrictive sense.

What is claimed is:

1. An apparatus comprising:

a direct-to-product printing tray to hold a photo product and a plurality of labels in place while a composite image is printed on the photo product and a first label, the direct-to-product printing tray including a label-dispensing system within the direct-to-product tray, the label-dispensing system configured to, in response to the removal of the first label from the label-dispensing system, automatically advance a second label to a position previously occupied by the first label.

2. The apparatus of claim 1, wherein the plurality of labels is secured in a stack within the label-dispensing system.

3. The apparatus of claim 1, wherein the label-dispensing system includes a spring to exert an upward force on the stack and a retaining lip to exert a downward force on the stack.

4. The apparatus of claim 1, wherein the label-dispensing system comprises a cartridge to be inserted into and removed from the direct-to-product printing tray, and wherein the plurality of labels is secured in a stack within the cartridge.

5. The apparatus of claim 4, wherein the cartridge includes a spring-loaded follower to cause the automatic advancement of the second label in response to removal of the first label.

6. The apparatus of claim 4, wherein the direct-to-product printing tray includes an opening in a bottom portion of the direct-to-product printing tray to receive the cartridge.

7. The apparatus of claim 4, wherein the direct-to-product printing tray includes an opening in a top portion of the direct-to-product printing tray to receive the cartridge.

8. The apparatus of claim 4, wherein a bottom portion of the cartridge opens to receive the plurality of labels.

9. The apparatus of claim 4, wherein a top portion of the cartridge opens to receive the plurality of labels.

10. The apparatus of claim 4, wherein the direct-to-product printing tray includes a retaining lip to retain the cartridge within the direct-to-product printing tray.

11. The apparatus of claim 4, wherein the cartridge includes lateral flanges and the direct-to-product printing tray includes recesses configured to receive the lateral flanges.

12. The apparatus of claim 4, wherein the cartridge includes a fastener to secure the cartridge in place when inserted within the tray.

13. The apparatus of claim 12, wherein the fastener comprises a spring, latch, or a magnet.

14. The apparatus of claim 1, wherein the composite image includes a plurality of personalized images and a plurality of label images, a position of each personalized image within the composite image corresponding to a position of a separate photo product on the direct-to-product printing tray and a position of each label image within the composite image corresponding to a position of a separate label on the direct-to-product printing tray.

15. The apparatus of claim 14, wherein the label image includes order tracking information.

16. A direct-to-product printer comprising:

a printer head to print a composite image;

a direct-to-product printing tray to hold a photo product and a plurality of labels in place while the composite image is printed on the photo product and a first label, the direct-to-product printing tray including a label-dispensing system within the direct-to-product tray, the label-dispensing system configured to, in response to the removal of the first label from the label-dispensing system, automatically advance a second label to a position previously occupied by the first label; and a flatbed platter to secure the direct-to-product printing tray.

17. The direct-to-product printer of claim 16, wherein the plurality of labels is secured in a stack within the label-dispensing system.

18. The direct-to-product printer of claim 16, wherein the label-dispensing system includes a spring to exert an upward force on the stack and a retaining lip to exert a downward force on the stack.

19. The direct-to-product printer of claim 16, wherein the label-dispensing system comprises a cartridge to be inserted into and removed from the direct-to-product printing tray, and wherein the plurality of labels is secured in a stack within the cartridge.

20. The apparatus of claim 19, wherein the cartridge includes a spring-loaded follower to cause the automatic advancement of the second label in response to removal of the first label.

* * * * *